US009695989B2

(12) United States Patent
Hsieh et al.

(10) Patent No.: US 9,695,989 B2
(45) Date of Patent: Jul. 4, 2017

(54) PLASTIC LAMP BASE WITH ZIGZAG ELECTRICAL CONDUCTOR AND LIGHT BULB USING THE SAME

(71) Applicant: Gixia Group Co., Jhubei (TW)

(72) Inventors: Jung-Ya Hsieh, Jhubei (TW); Yung-Fu Lin, Jhubei (TW); Yuan-Hsin Chang, Jhubei (TW)

(73) Assignee: Gixia Group Co., Jhubei (TW)

( * ) Notice: Subject to any disclaimer, the term of this patent is extended or adjusted under 35 U.S.C. 154(b) by 28 days.

(21) Appl. No.: 14/958,531

(22) Filed: Dec. 3, 2015

(65) Prior Publication Data

US 2016/0178134 A1 Jun. 23, 2016

(30) Foreign Application Priority Data

Dec. 23, 2014 (CN) ..... 2014 1 0808779

(51) Int. Cl.

| | |
|---|---|
| ***F21V 1/00*** | (2006.01) |
| ***F21K 99/00*** | (2016.01) |
| ***F21V 15/01*** | (2006.01) |
| ***F21K 9/23*** | (2016.01) |
| *F21V 23/00* | (2015.01) |
| *F21Y 115/10* | (2016.01) |

(52) U.S. Cl.

CPC ..... *F21K 9/1355* (2013.01); *F21K 9/23* (2016.08); *F21V 15/01* (2013.01); *F21V 23/002* (2013.01); *F21Y 2115/10* (2016.08)

(58) Field of Classification Search

CPC ..... F21K 9/1355; F21K 9/23; F21V 15/01; F21V 23/002; F21Y 2105/10

See application file for complete search history.

(56) References Cited

U.S. PATENT DOCUMENTS

| | | | | |
|---|---|---|---|---|
| 2010/0060130 | A1* | 3/2010 | Li | F21V 29/004 313/46 |
| 2010/0097811 | A1* | 4/2010 | Betsuda | F21K 9/135 362/362 |
| 2013/0016512 | A1* | 1/2013 | Breidenassel | F21V 29/004 362/249.01 |
| 2015/0124454 | A1* | 5/2015 | Honold | F21V 29/70 362/293 |

* cited by examiner

*Primary Examiner* — Ali Alavi

(74) *Attorney, Agent, or Firm* — Wang Law Firm, Inc.

(57) ABSTRACT

A plastic lamp base includes an insulated body defining therein an enabling channel which extends from a bottom end thereof. Also, the insulated body defines therein an auxiliary channel which extends from a mounting end thereof to communicate with the enabling channel. The enabling channel and the auxiliary channel are filled with a conductive plastic to form a zigzag electrical conductor, which has one end exposed at the bottom end of the insulated body and has an opposite end exposed at the mounting end of the insulated body and electrically connected to one contact of an LED component. A ground electrical conductor, being electrically insulated from the zigzag electrical conductor, has one end exposed at the outer surface of the insulated body and has an opposite end exposed at the mounting end of the insulated body and electrically connected to the other contact of the LED component.

10 Claims, 10 Drawing Sheets

PLASTIC LAMP BASE WITH ZIGZAG ELECTRICAL CONDUCTOR AND LIGHT BULB USING THE SAME

FIELD OF THE INVENTION

The present invention relates to a plastic lamp base with a zigzag electrical conductor and an LED bulb using the plastic lamp base.

BACKGROUND OF THE INVENTION

Due to several advantages of LEDs, such as high luminous efficiency, fast response, no warm-up period, long lifetime, rugged structure, less power consumption, environmentally friendly, small size and so on, many researches on LED bulbs have been conducted. As a result, LED bulbs have gradually replaced conventional incandescent bulbs. FIG. 9 shows a conventional LED bulb 7, which employs a metal base with external threads compatible to the existing standards for lamp bases, wherein the threads have a predetermined pitch between two adjacent threads and have a radius for screwing into to a socket. The LED component used in the bulb has two contacts which are respectively electrically connected to the external threads and the bottom end of the metal base via two metal wires. As such, the LED component can receive electrical current to emit light beams.

However, for fixing the metal wires and preventing a short circuit of the metal wires, the inner surface of the metal base is required to be provided with an insulated material. Furthermore, a transparent case is required to be mounted over the LED component. Manufacturing such an LED bulb involves multiple processing steps, which includes forming a metal base, forming an insulated material on the inner surface of the metal base, mounting an LED component and metal wires, making a transparent case, and mounting the transparent case to the metal base. The complicated manufacturing process results in a high cost of the LED bulb. Since the metal wires requires to be soldered to the metal base, and the metal base requires to be provided with an insulated material, the associated bonding surfaces therebetween should be treated with precision; otherwise, a roughened appearance will result. Furthermore, a bulb using multiple materials will lead to a problem in recycling it and thus depart from the global trend of environmental protection.

Currently, there is another type of lamp base, as shown in FIG. 10, wherein two electrical conductors for connecting with an LED component are made of a conductive plastic, whereas the lamp base 9, which replaces the metal bases commonly used in the existing bulbs, is made of a non-conductive plastic.

Generally, a product using two kinds of plastic, such as a plastic lamp base, can be manufactured in two ways: (1) double injection molding which simultaneously injects two kinds of plastic; (2) insert molding which first forms an object of a first plastic and then places the object in a mold which is then filled with a second plastic. Regarding the technology of double injection molding, it is difficult to control the precision and accuracy of a plastic lamp base, especially the conductors thereof, so that this technology usually leads to a higher cost. Besides, the product yields are poor and thus may cause inefficiency in making the products. As to the technology of insert molding, because the electrical conductors of a plastic lamp base are small in size, they cannot be formed in advance of the insulated body thereof. First, the insulated body is formed by injection molding, wherein some portions of the insulated body are hollowed out and reserved for the electrical conductors. After the insulated body is formed, the hollowed portion can be injected with a second material to form the electrical conductors.

For opening the mold more easily, the conductors of the plastic lamp base are designed in straight shape rather than curved or inclined shape; therefore, they cannot be applied in commonly used Edison Screw Base, including E13, E26 or E27. They can only be applied in a lamp base of bi-pin style. However, due to the plastic pins of the lamp base, which extends downwardly from the bottom of the lamp base, being lack of sufficient structural strength, there is no mature product of this type of lamp base existed on the market so far.

In view of the foregoing, the present invention seeks to provide a plastic lamp base, which can be made by a batch production using basic molding technique, without requiring a complex double injection molding, to promote the production capacity, the product efficiency and yields, and to reduce the manufacturing cost.

SUMMARY OF THE INVENTION

One object of the present invention is to provide a plastic lamp base, which can be made using a simple injection molding technique to promote the product yields and reduce the manufacturing cost.

Another object of the present invention is to provide a plastic lamp base, which is made by plastic injection molding rather metal sheet pressing, whereby the structure of the lamp base can be simplified.

A further object of the present invention is to provide a plastic lamp base, which can be made through an automatic process, so that the production efficiency can be increased so as to meet the scale requirement for mass production.

A still further object of the present invention is to provide an LED bulb using a plastic lamp base mentioned above, which has a high degree of precision and accuracy, so that the appearance and product yields of the bulb can be improved so as to meet the scale requirement for mass production.

A yet still further object of the present invention is to provide an LED bulb using a plastic lamp base mentioned above, wherein the lamp base is compatible to an Edison Screw socket, so that consumers can replace a conventional bulb with the LED bulb.

To achieve the above objects, the plastic lamp base may include an insulated body, a zigzag electrical conductor, and a ground electrical conductor. The insulated body, which is made of plastic, has an outer surface, a mounting end for mounting at least one LED component, and a bottom end opposite to the mounting end. The LED component has at least two contacts. The insulated body defines therein a non-getting-wider enabling channel which extends from the bottom end towards the mounting end thereof, wherein the enabling channel and the bottom end of the insulated body are intersected at a first center. The insulated body defines therein at least one non-getting-wider auxiliary channel which extends downwardly from the mounting end towards the bottom end thereof to communicate with the enabling channel, wherein the auxiliary channel and the mounting end of the insulated body are intersected at a second center which is offset from the first center. The zigzag electrical conductor is formed in the enabling channel and the auxiliary channel. One end of the zigzag electrical conductor is exposed at the bottom end of the insulated body. An opposite end of the zigzag electrical conductor is exposed at the mounting end of the insulated body and electrically connected to one of the contacts of the LED component. One end of the ground electrical conductor is exposed at the outer surface of the insulated body. An opposite end of the ground electrical conductor is exposed at the mounting end of the insulated body and electrically connected to the other one of the contacts of the LED component. The ground electrical conductor is electrically insulated from the zigzag electrical conductor.

The LED bulb includes at least one LED component, an insulated body, a zigzag electrical conductor, and a ground electrical conductor. The insulated body, which is made of plastic, has an outer surface, a mounting end for mounting the LED component, and a bottom end opposite to the mounting end. The LED component has at least two contacts. The insulated body defines therein a non-getting-wider enabling channel which extends from the bottom end towards the mounting end thereof, wherein the enabling channel and the bottom end of the insulated body are intersected at a first center. The insulated body defines therein at least one non-getting-wider auxiliary channel which extends downwardly from the mounting end towards the bottom end thereof to communicate with the enabling channel, wherein the auxiliary channel and the mounting end of the insulated body are intersected at a second center which is offset from the first center. The zigzag electrical conductor is formed in the enabling channel and the auxiliary channel. One end of the zigzag electrical conductor is exposed at the bottom end of the insulated body. An opposite end of the zigzag electrical conductor is exposed at the mounting end of the insulated body and electrically connected to one of the contacts of the LED component. One end of the ground electrical conductor is exposed at the outer surface of the insulated body. An opposite end of the ground electrical conductor is exposed at the mounting end of the insulated body and electrically connected to the other one of the contacts of the LED component. The ground electrical conductor is electrically insulated from the zigzag electrical conductor.

The zigzag electrical conductor, which is formed in the enabling channel and the auxiliary channel of the insulated body of the plastic lamp base and the LED bulb, can be made using a simple molding technique to achieve the effect of batch production, increase the production yields, and lower the difficulty in manufacturing the product, as compared to conventional lamp bases. In addition, since the precision and accuracy of the plastic lamp base of the present invention is improved over conventional metal lamp bases, the plastic lamp base of the present invention can achieve a more sensible design for a lamp base.

BRIEF DESCRIPTION OF THE DRAWINGS

The foregoing and other features and advantages of illustrated embodiments of the present invention will be more readily apparent from the following detailed description, which proceeds with reference to the accompanying drawings.

DETAILED DESCRIPTION OF THE ILLUSTRATED EMBODIMENTS

The foregoing and other technical contents, features and advantages of the present invention will be illustrated in detail by way of exemplary embodiments with reference to the accompanying drawings. In the exemplary embodiments, same elements or steps will be indicated by similar numerals or labels.

Figure 1:
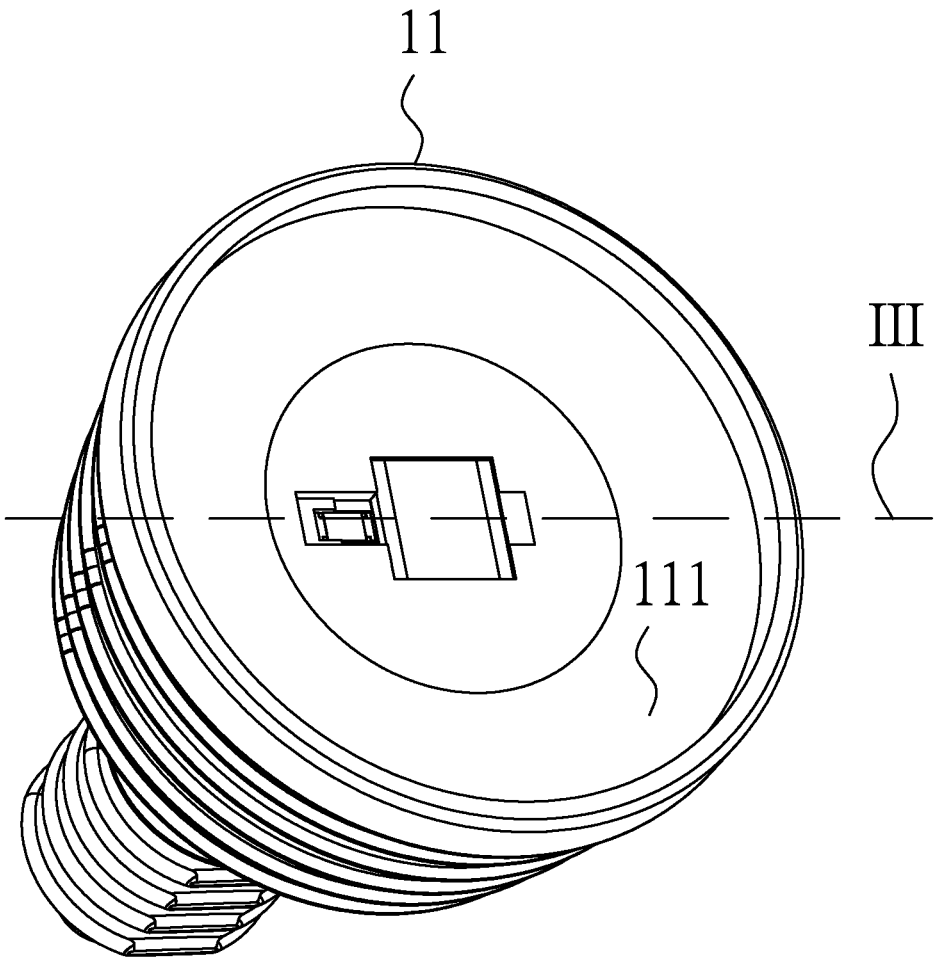
FIG. 1 shows a 3-dimensional view of a plastic lamp base according to a first embodiment of the present invention, wherein an insulated body has a mounting end for mounting an LED component.
Figure 2:
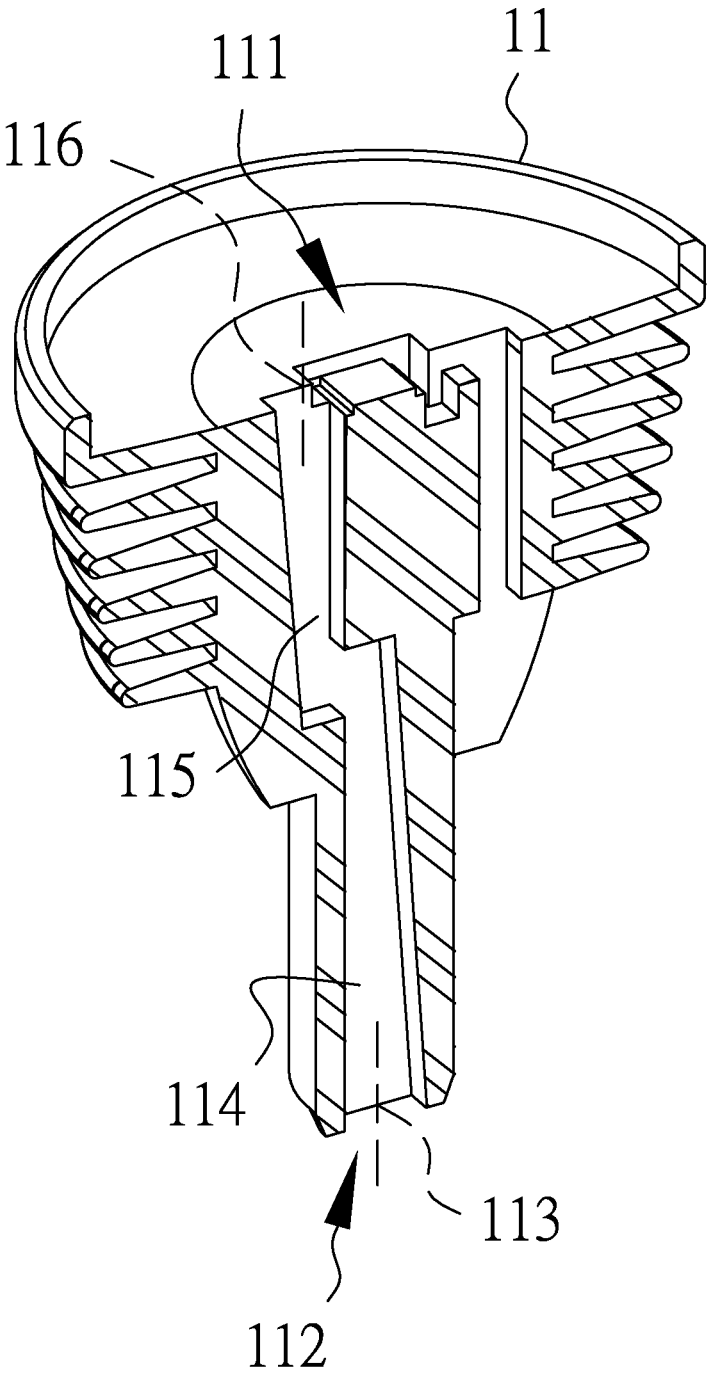
FIG. 2 shows a 3-dimensionally sectional view of the plastic lamp base of the first embodiment, wherein the insulated body defines an enabling channel and an auxiliary channel communicating each other.
Figure 3:
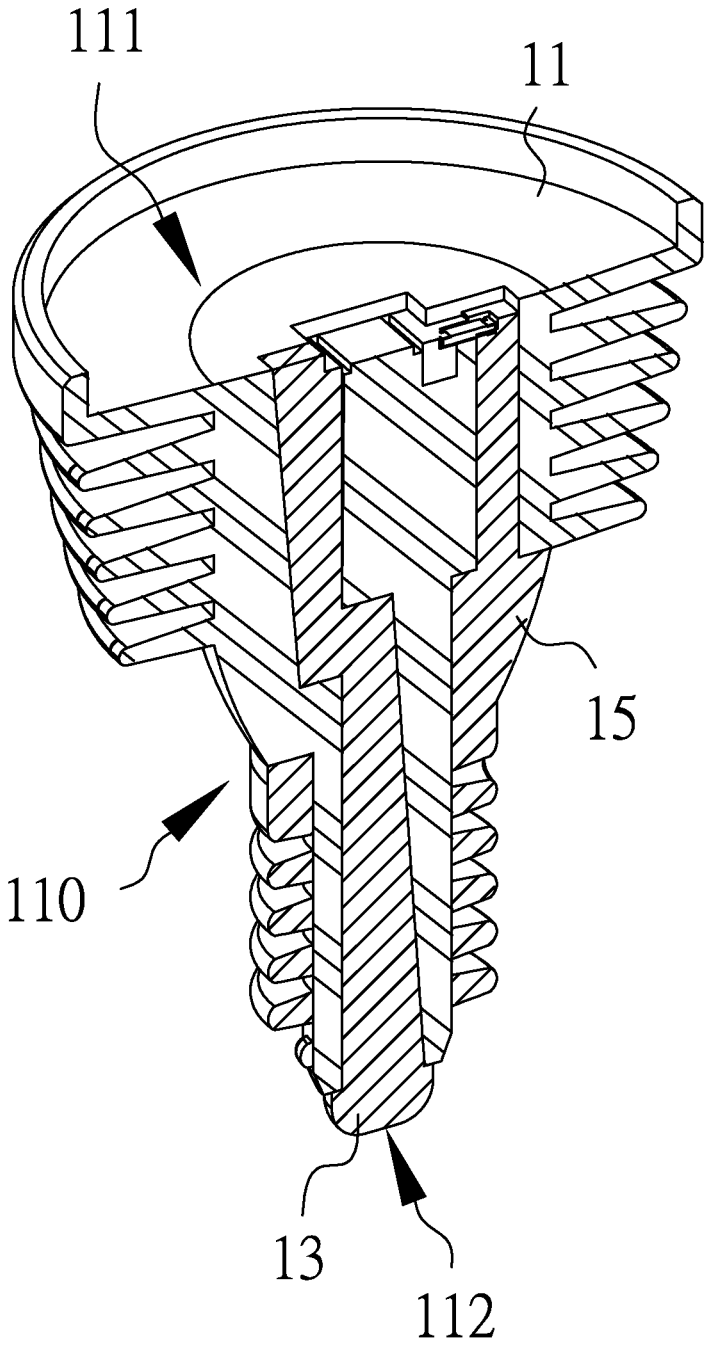
FIG. 3 shows a 3-dimensionally sectional view of the plastic lamp base of the first embodiment, wherein the enabling channel and the auxiliary channel of the insulated body are filled with molten conductive plastic, which can be formed into a thunderbolt-shaped zigzag electrical conductor after being cooled.

Referring to FIGS. 1, 2 and 3, a plastic lamp base according to a first embodiment of the present invention is shown, which generally comprises an insulated body 11 having flat mounting end 111, a bottom end 112 opposite to the mounting end 111, and an outer surface 110 formed therebetween. In this embodiment, the insulated body 11 defines an enabling channel 114 which is getting narrower and extends upwardly from the bottom end 12 towards the mounting end 111, and defines an auxiliary channel 115 which is getting narrower and extends downwardly from the mounting end 111 towards bottom end 112, wherein the two channels 114, 115 communicates with each other at their narrower ends.

Furthermore, the enabling channel 114 and the bottom end 112 are intersected at a first center 113, whereas the auxiliary channel 115 and the mounting end 111 are intersected at a second center 116. The first center 113 is offset from the second center 116, irrespectively of being viewed from above the mounting end 111 or below the bottom end 112. In this embodiment, although the enabling channel 114 and the auxiliary channel 115 are getting narrower as they extend through the insulated body 11, each channel can extend through the insulated body with a constant cross section along its entire path, without causing a problem of removing the shaped body from a mold. Hereinafter, a channel with constant or gradually narrower cross section is termed a "non-getting-wider" channel.

In manufacturing the plastic lamp base, after the insulated body 11 has been removed from a mold, the enabling channel 114 and the auxiliary channel 115 are filled with molten conductive plastic. The conductive plastic provided in the enabling channel 114 and the auxiliary channel 115 is formed into a zigzag electrical conductor 13, one end of which is exposed at the bottom end 112, and an opposite end of which is exposed at the mounting end 111. The zigzag electrical conductor 13 has a shape of a thunderbolt and is different from a straight or curved conductor commonly seen in conventional lamp bases. At the same time, a ground electrical conductor 15 is formed in the insulated body 11, wherein one end of the ground electrical conductor 15 is exposed at the outer surface 115, and an opposite end of the ground electrical conductor 15 is exposed at the mounting end 111. The ground electrical conductor 15 is electrically insulated from the zigzag electrical conductor 13.

Generally, the enabling channel 114 is larger than the auxiliary channel 115 in cross section, as shown in FIG. 2. Thus, the lower portion of the zigzag electrical conductor 13 is larger than the upper portion of the zigzag electrical conductor 13 in cross section. In this embodiment, the change rates of the lower and upper portions of the zigzag electrical conductor 13 are not required to be the same. Since one auxiliary channel occupies less space, it is possible for the insulated body 11 to define multiple auxiliary channels. Nevertheless, the cross section of the enabling channel 114 may be the same as the cross section of the auxiliary channel 115, or alternatively, the cross section of the enabling channel 114 may be smaller than the cross section of the auxiliary channel 115.

Next, an LED component can be mounted at the mounting end 111 of the insulated body 11. The LED component has two contacts respectively corresponding to the ground electrical conductor 15 and the zigzag electrical conductor 13, which are exposed at the mounting end 111. Thus, in use, electrical current can flow through the zigzag electrical conductor 13, the LED component, and the ground electrical conductor 15, thus forming an electrical current loop. Furthermore, persons skilled in the art may know that the conductive plastic can be replaced by a conductive adhesive containing electrically conductive additives, provided that the adhesive can be introduced into the two channels. After the adhesive is cooled, the electrical conductors can be shaped. The zigzag electrical conductor of the present invention can be made using a simple molding process, which employs a batch injection technique instead of a double injection technique used in conventional plastic products. Therefore, the structure of a lamp base can be simplified as a plastic lamp base, the manufacturing precision and accuracy of the lamp base can be increased, and the appearance of the lamp base can be more exquisite than a metal lamp base. Due to the improved structure of the plastic lamp base of the present invention, the product yields can be increased, thus facilitating mass production, reducing the manufacturing cost, and increasing the market competitiveness.

Figure 4:
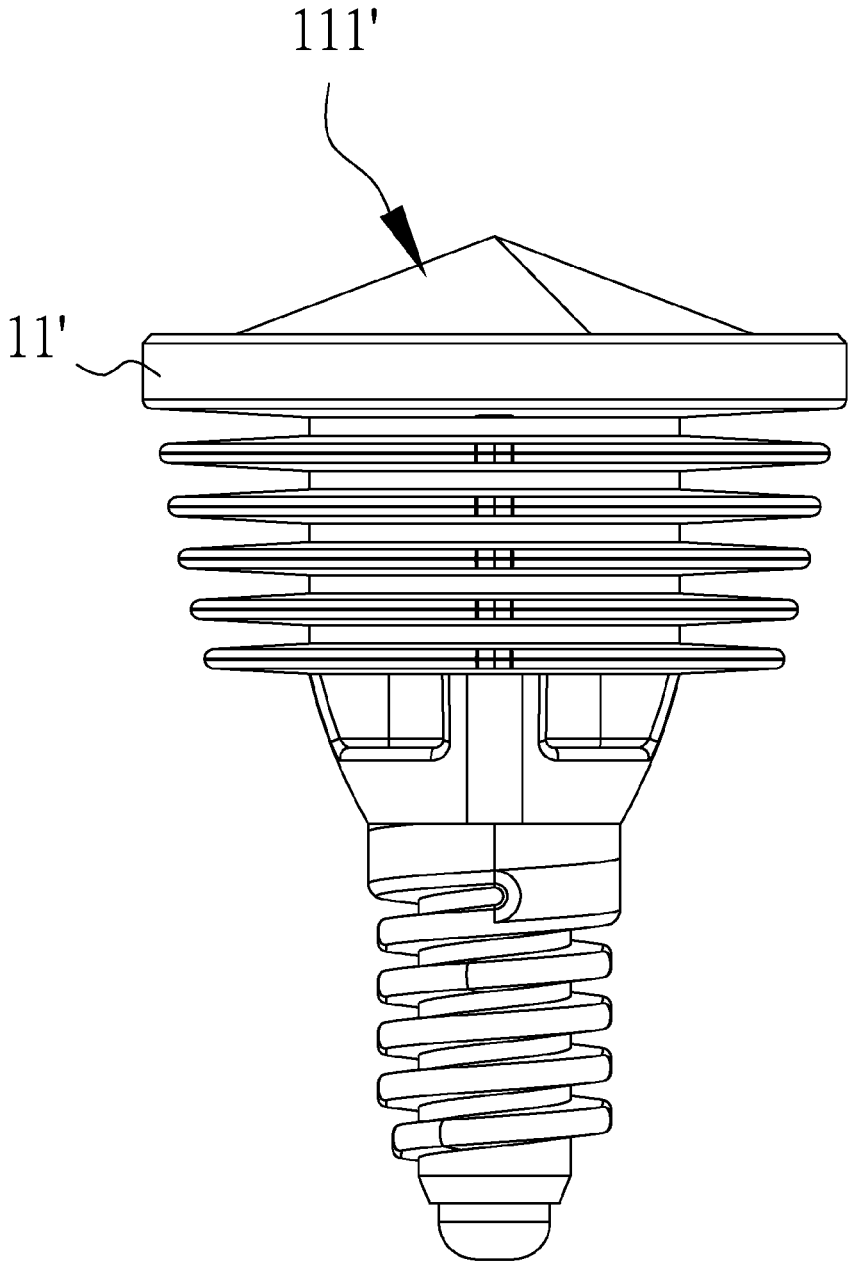
FIG. 4 shows a side view of a plastic lamp base according to a second embodiment of the present invention, wherein the mounting end of the insulated body is formed with a pyramidal structure which has four plane faces for mounting four LED components.
Figure 5:
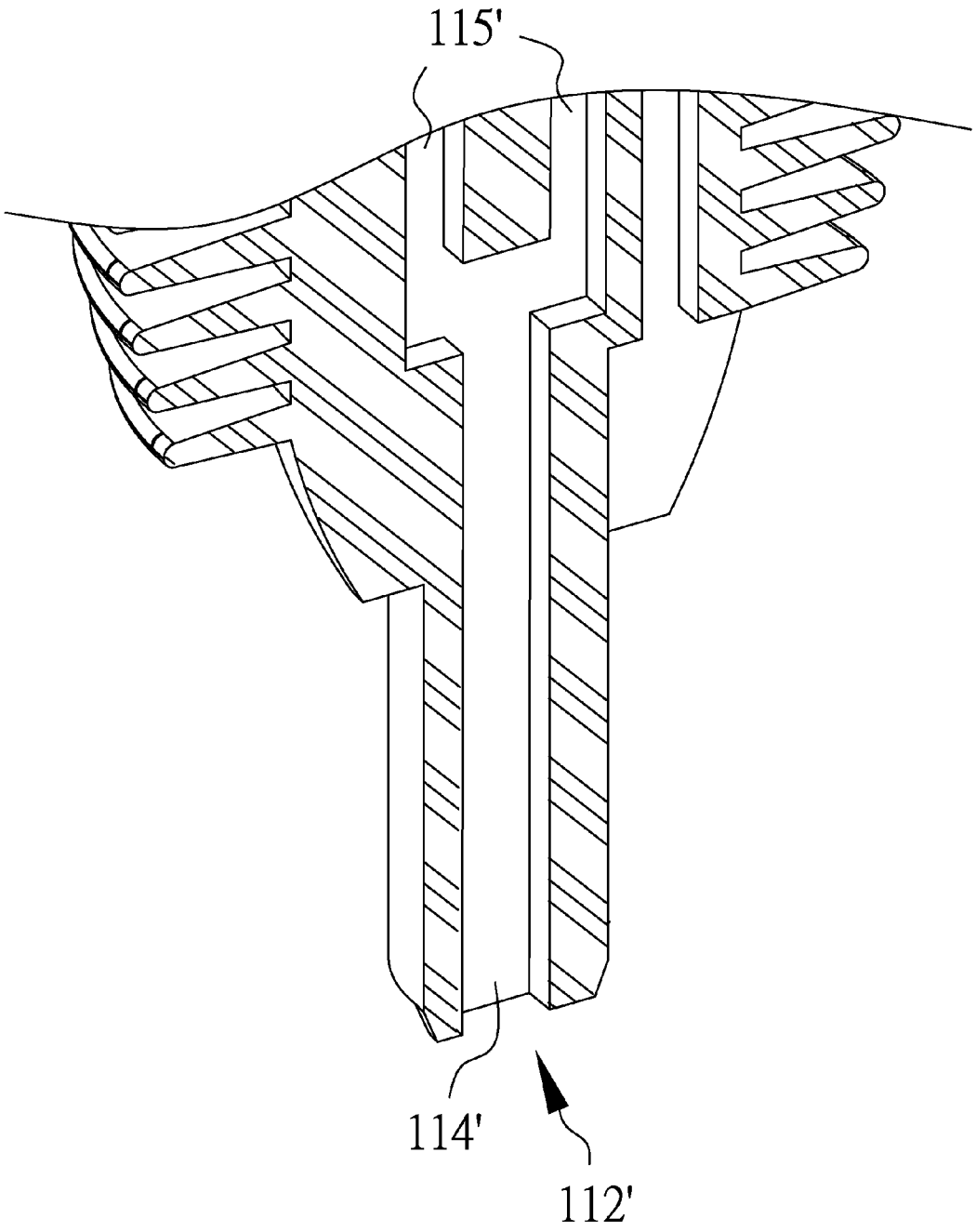
FIG. 5 shows a partially sectional view of the plastic lamp base of the second embodiment, wherein the enabling channel is split into four auxiliary channels for making a zigzag electrical conductor that can electrically connected to the four LED components.

FIG. 4 shows a second embodiment of the plastic lamp base, wherein the mounting end 111' is formed with a pyramidal structure, which has four plane faces each for mounting an LED component thereon. Thus, the mounting end 111' can mount four LED components, so as to have a wide illumination scope. Of course, the mounting end 111' is not limited to be formed with a pyramidal structure. The mounting end can be formed with a multi-faced structure according to the requirement of an application. For supplying electricity to the four LED components on the four plane faces of the pyramidal structure, as shown in FIG. 5, four auxiliary channels 115' are defined in the insulated body. The four auxiliary channels 115' respectively extend from the four plane faces to communicate with an enabling channel 114' which extends from the bottom end 112' of the insulated body.

The zigzag electrical conductor, which looks like a fork, has main stem being divided into four branches which respectively extend to the four plane faces of the mounting end 111'. This feature allows the insulated body to accommodate multiple LED components for increasing the illumination scope. In this embodiment, all of the enabling channel 114' and the auxiliary channels 115' are a "non-getting-wider" channel; this means that the channels may have a straight and parallel relationship with each other. Thus, the auxiliary channels 115' occupies less space, so that the insulated body allows more auxiliary channels to be defined therein to facilitate a design of a branched electrical conductor.

Figure 6:
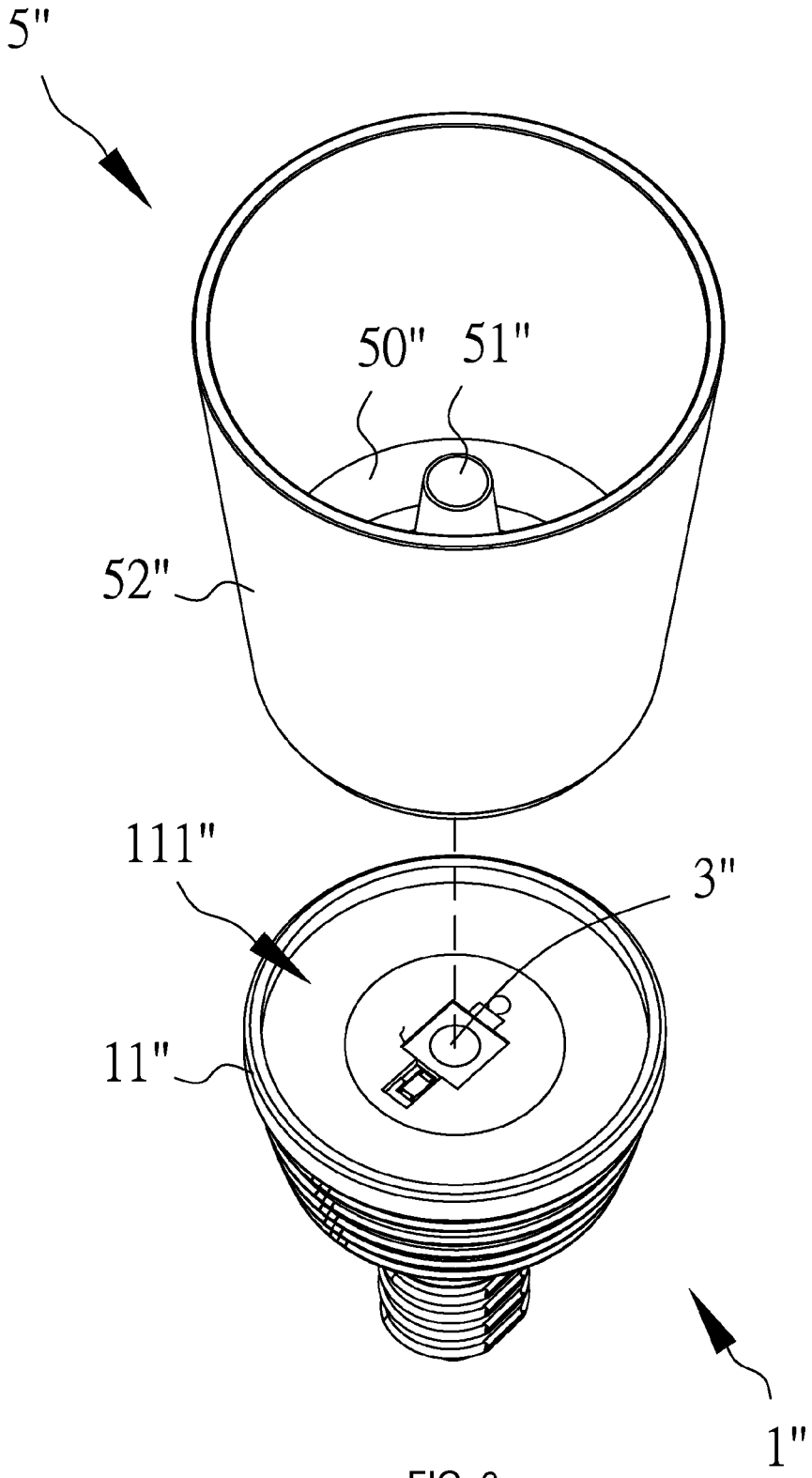
FIG. 6 shows an exploded view of a light bulb using a plastic lamp base of the present invention, wherein a light-transmitting lampshade is attached to the mounting end of the insulated body of the plastic lamp base.
Figure 7:
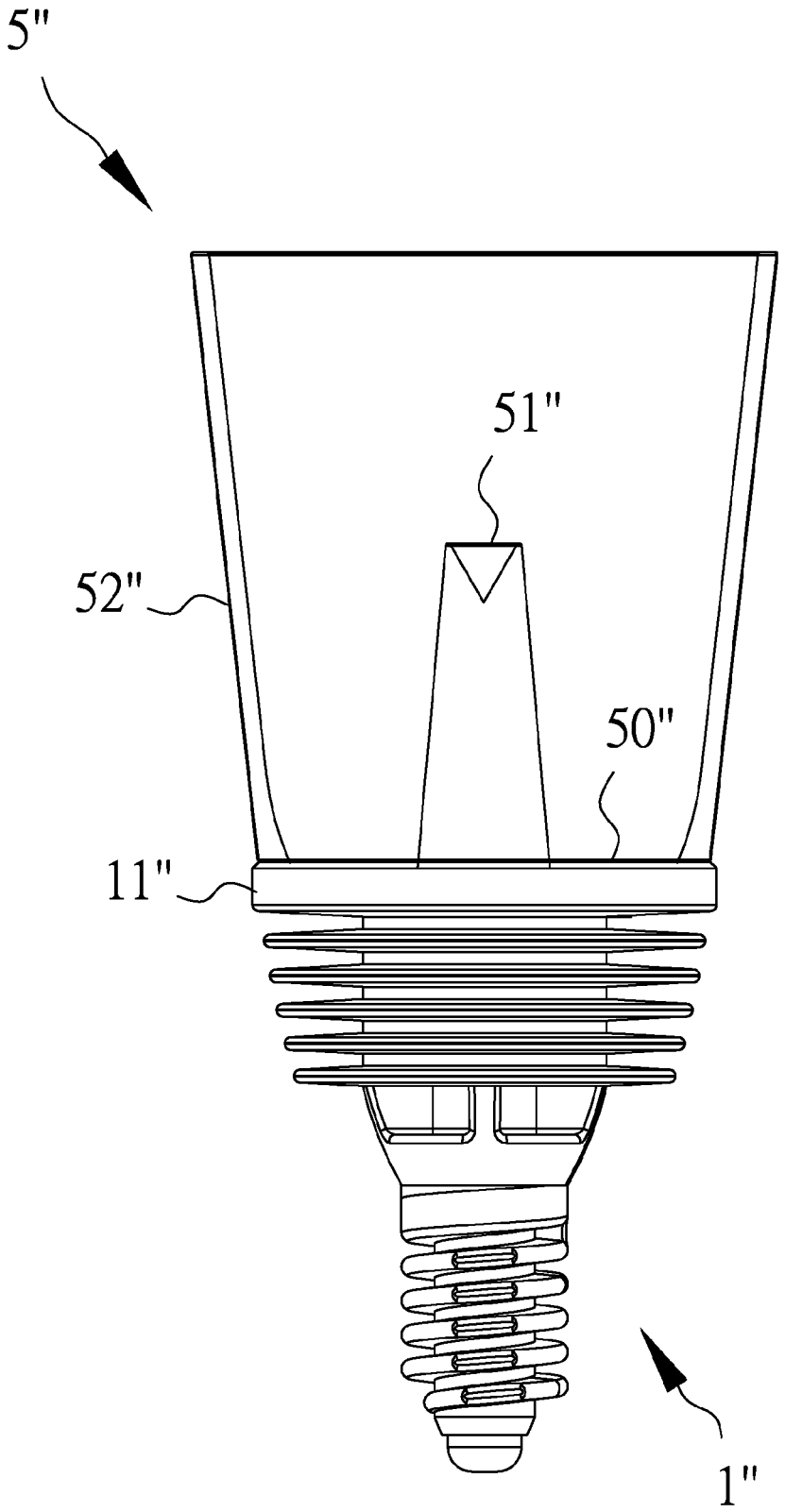
FIG. 7 shows a plan view of the light bulb, wherein the light-transmitting lampshade has a light-transmitting bottom, and an optical cup and an optical column extending from the light-transmitting bottom of the light-transmitting lampshade.

FIGS. 6 and 7 show a light bulb of the present invention, which employs a plastic lamp base of the present invention, wherein an LED component 3" and a light-transmitting lampshade 5" are mounted to the plastic lamp base 1". Specifically, the light bulb can be obtained by mounting the LED component 3" and the light-transmitting lampshade 5" onto the mounting end 111" of the insulated body 11" as mentioned in the plastic lamp base of the first embodiment. The light-transmitting lampshade 5" can be made using plastic injection molding, so that the manufacturing precision and accuracy of the lampshade can be increased, and the manufacturing cost can be reduced. Furthermore, the lampshade can be easily assembled to the plastic lamp base. The light-transmitting lampshade 5" has a light-transmitting bottom 50" located on the mounting end 111" of the insulated body 11", an annular optical cup 52" extending from a periphery of the light-transmitting bottom 50" and surrounding the LED component 3", and an optical column 51" corresponding to a light-emitting surface of the LED component 3" and extending from the light-transmitting bottom 50", so that light beams emitting from the LED component 3" can be guided into the optical column 51" and then delivered out of the optical column 51" to provide a wider illumination scope.

Figure 8:
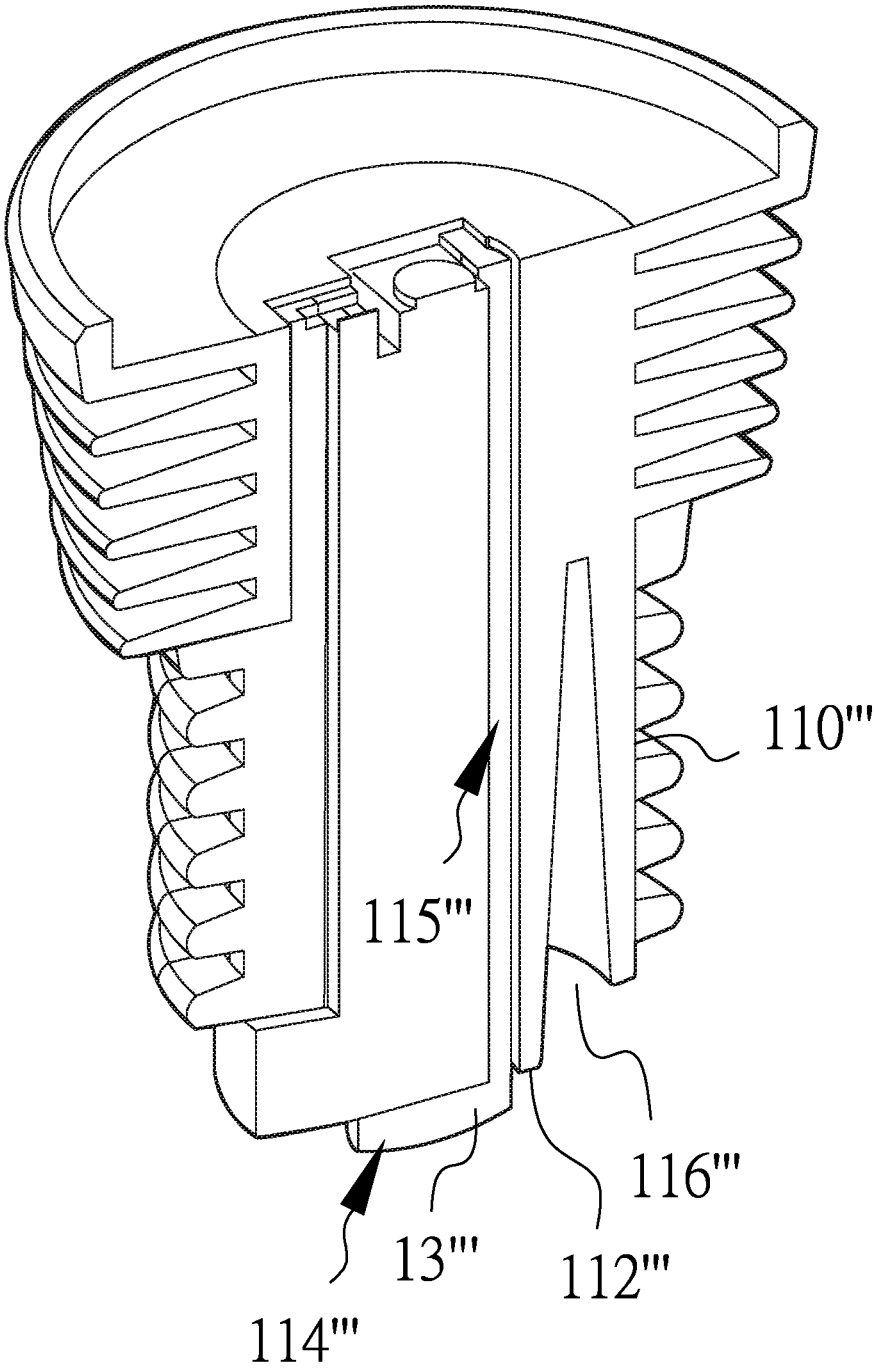
FIG. 8 shows a modified form of the zigzag electrical conductor used in a plastic lamp base of the present invention.
Figure 9:
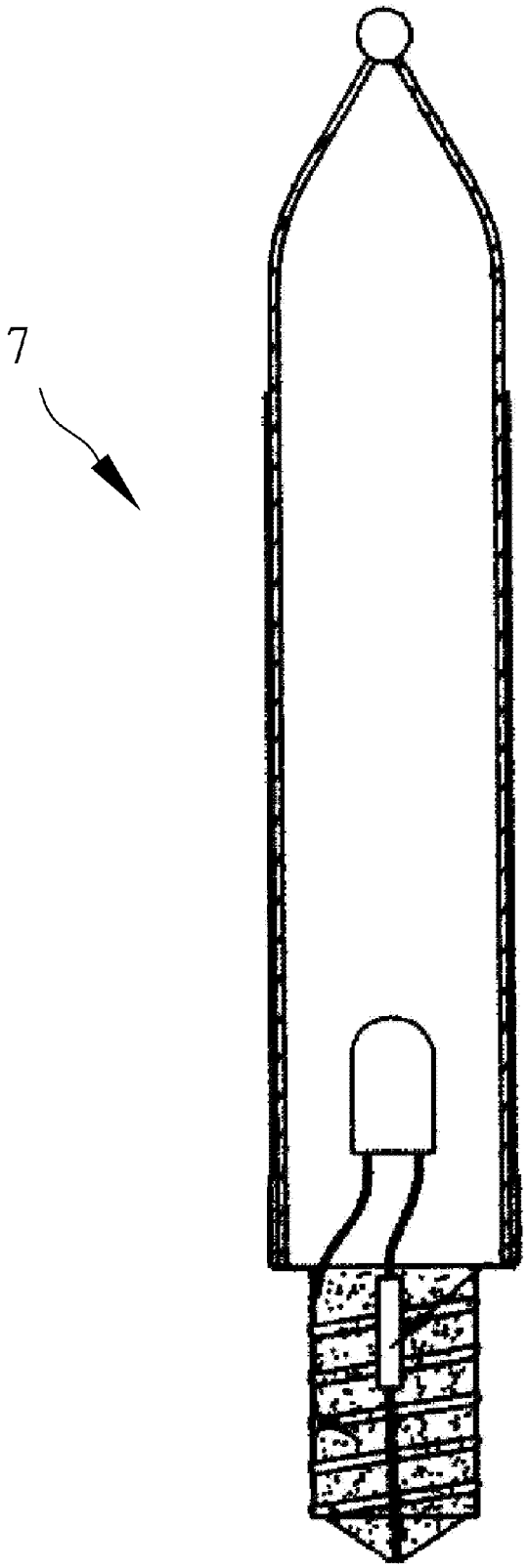
PRIOR ART FIG. 9
FIG. 9 shows a plan view of an LED bulb of prior art.
Figure 10:
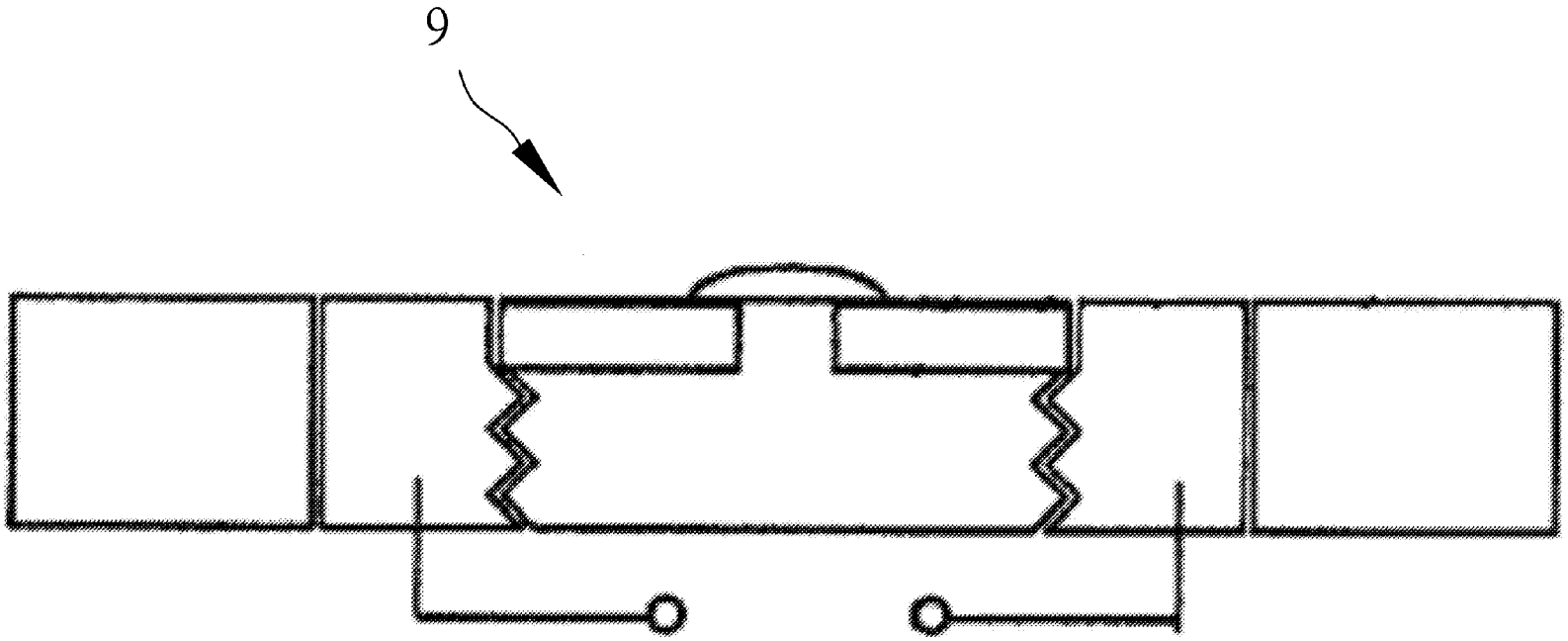
PRIOR ART FIG. 10
FIG. 10 shows a schematic view of a plastic lamp base of prior art, wherein the insulated body is made of a non-conductive plastic whereas the electrical conductors are made of a conductive plastic.

The price of conductive plastic is triple more than that of non-conductive plastic. Furthermore, the more the brightness of an LED component is achieved, the more the heat is generated. For mitigating these problems, a third embodiment of the plastic lamp base, as shown in FIG. 8 is preferred, wherein a recess 116'" is defined into the bottom end 112'" of the insulated body of the lamp base, between the zigzag electrical conductor 13'" and the outer surface 110'" of the insulated body, so that outside air can flow into the recess 116'" to dissipate heat. Furthermore, in this embodiment, the auxiliary channel 115'", which extends to the bottom end 112'" of the insulated body, has a reduced cross section, compared to the auxiliary channels of the previous embodiments, so that the amount of the conductive plastic used to make the zigzag electrical conductor 13'" can be reduced, and thus the cost of the plastic lamp base can be further reduced.

The conductive plastic used in the zigzag electrical conductor and the ground electrical conductor can be obtained by adding electrically conductive additives into a plastic material. The electrically conductive additives can be selected from copper, nickel, tin, aluminum, the alloy made from the foregoing elements, or graphite powder. Each of the zigzag electrical conductor and the ground electrical conductor has a predetermined resistance, so that external resistors for the light bulb using the plastic lamp base are unnecessary, thereby saving cost and space.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A plastic lamp base, comprising:

an insulated body made of plastic, which has an outer surface, a mounting end for mounting at least one LED component, and a bottom end opposite to the mounting end, the LED component having at least two contacts, the insulated body defining therein a non-getting-wider enabling channel which extends from the bottom end towards the mounting end thereof, the enabling channel and the bottom end of the insulated body being intersected at a first center, the insulated body defining therein at least one non-getting-wider auxiliary channel which extends from the mounting end towards the bottom end thereof to communicate with the enabling channel, the auxiliary channel and the mounting end of the insulated body being intersected at a second center which is offset from the first center;

a zigzag electrical conductor formed in the enabling channel and the auxiliary channel, one end of the zigzag electrical conductor being exposed at the bottom end of the insulated body, an opposite end of the zigzag electrical conductor being exposed at the mounting end of the insulated body and electrically connected to one of the contacts of the LED component; and a ground electrical conductor, one end of which is exposed at the outer surface of the insulated body, and another end of which is exposed at the mounting end of the insulated body and electrically connected to the other one of the contacts of the LED component, the ground electrical conductor being electrically insulated from the zigzag electrical conductor.

2. The plastic lamp base of claim 1, wherein the zigzag electrical conductor and the ground electrical conductor are made of a conductive plastic containing electrically conductive additives.

3. The plastic lamp base of claim 2, wherein the conductive additives are copper, nickel, tin, aluminum, the alloy made from the foregoing elements, or carbon powder, whereby each of the zigzag electrical conductor and the ground electrical conductor has a predetermined resistance.

4. The plastic lamp base of claim 1, wherein the zigzag electrical conductor and the ground electrical conductor are made of a conductive adhesive containing electrically conductive additives, the conductive adhesive being shaped into the electrical conductors after being cooled.

5. An LED light bulb, comprising:

at least one LED component; and a plastic lamp base, including:

an insulated body made of plastic, which has an outer surface, a mounting end for mounting the LED component, and a bottom end opposite to the mounting end, the LED component having at least two contacts, the insulated body defining therein a non-getting-wider enabling channel which extends from the bottom end towards the mounting end thereof, the enabling channel and the bottom end of the insulated body being intersected at a first center, the insulated body defining therein at least one non-getting-wider auxiliary channel which extends from the mounting end towards the bottom end thereof to communicate with the enabling channel, the auxiliary channel and the mounting end of the insulated body being intersected at a second center which is offset from the first center;

a zigzag electrical conductor formed in the enabling channel and the auxiliary channel, one end of the zigzag electrical conductor being exposed at the bottom end of the insulated body, an opposite end of the zigzag electrical conductor being exposed at the mounting end of the insulated body and electrically connected to one of the contacts of the LED component; and a ground electrical conductor, one end of which is exposed at the outer surface of the insulated body, and another end of which is exposed at the mounting end of the insulated body and electrically connected to the other one of the contacts of the LED component, the ground electrical conductor being electrically insulated from the zigzag electrical conductor.

6. The LED light bulb of claim 5, wherein the zigzag electrical conductor and the ground electrical conductor are made of a conductive plastic containing electrically conductive additives.

7. The LED light bulb of claim 5, wherein the zigzag electrical conductor and the ground electrical conductor are made of a conductive adhesive containing electrically conductive additives, the conductive adhesive being shaped into the electrical conductors after being cooled.

8. The LED light bulb of claim 5, wherein the mounting end of the insulated body is formed with a multi-faced structure for mounting more than one LED component equi-angularly at plane faces thereof, wherein more than one auxiliary channel are defined in the insulated body, which respectively correspond to the LED components.

9. The LED light bulb of claim 5, further comprising a light-transmitting lampshade attached to the mounting end of the insulated body, around the LED component.

10. The LED light bulb of claim 9, wherein the LED component has a light-emitting surface, the light-transmitting lampshade having a light-transmitting bottom, an optical column which extends from the light-transmitting bottom and corresponds to the light-emitting surface of the LED component, and an optical cup extending from the light-transmitting bottom.

* * * * *